US008404990B2

(12) United States Patent
Lutgring et al.

(10) Patent No.: US 8,404,990 B2
(45) Date of Patent: Mar. 26, 2013

(54) SWITCH SYSTEM HAVING A BUTTON TRAVEL LIMIT FEATURE

(75) Inventors: David M. Lutgring, Indianapolis, IN (US); Michael J. Pescetto, Fishers, IN (US)

(73) Assignee: 3M Innovative Properties Company, St.Paul, MN (US)

( * ) Notice: Subject to any disclaimer, the term of this patent is extended or adjusted under 35 U.S.C. 154(b) by 342 days.

(21) Appl. No.: 12/827,158

(22) Filed: Jun. 30, 2010

(65) Prior Publication Data

US 2012/0000760 A1 Jan. 5, 2012

(51) Int. Cl.
*H01H 13/14* (2006.01)

(52) U.S. Cl. ..... 200/520

(58) Field of Classification Search ..... 200/5 A, 200/5 R, 520, 5 E, 512

See application file for complete search history.

(56) References Cited

U.S. PATENT DOCUMENTS

| | | | |
|---|---|---|---|
| 3,309,487 | A | 3/1967 | Fisher |
| 3,582,584 | A | 6/1971 | Best |
| 3,697,706 | A | 10/1972 | Huggard |
| 3,773,997 | A | 11/1973 | Evans et al. |
| 3,845,264 | A | 10/1974 | Twyford |
| 3,922,814 | A | 12/1975 | Runft |
| 3,939,318 | A | 2/1976 | Brown et al. |
| 3,964,593 | A | 6/1976 | Pointon |
| 3,965,399 | A | 6/1976 | Walker, Jr. et al. |
| 3,993,884 | A | 11/1976 | Kondur et al. |
| 4,002,871 | A | 1/1977 | Sims, Jr. |
| 4,002,879 | A | 1/1977 | Sims, Jr. |
| 4,017,700 | A | 4/1977 | West |
| 4,169,974 | A | 10/1979 | Peers-Trevarton |
| 4,242,546 | A | 12/1980 | Alonso |
| 4,286,131 | A | 8/1981 | Kopish et al. |
| 4,363,942 | A | 12/1982 | Deeg et al. |
| 4,479,040 | A | 10/1984 | Denley et al. |
| 4,712,092 | A | 12/1987 | Boldridge, Jr. et al. |
| 4,939,327 | A | 7/1990 | Wu et al. |
| 4,972,051 | A | 11/1990 | Hodson |
| 5,057,657 | A | 10/1991 | Skulic |
| 5,136,130 | A | 8/1992 | Daly |
| 5,228,561 | A | 7/1993 | Schroeder et al. |
| 5,418,530 | A | 5/1995 | Moore et al. |
| 5,428,197 | A | 6/1995 | McCurry et al. |
| 5,588,760 | A | 12/1996 | So |
| 5,720,379 | A | 2/1998 | Schwartz et al. |

(Continued)

FOREIGN PATENT DOCUMENTS

| | | | |
|---|---|---|---|
| EP | 0 423 924 | A1 | 4/1991 |
| EP | 0 810 619 | B1 | 9/2000 |

(Continued)

OTHER PUBLICATIONS

International Application No. PCT/US2011/036900 search report dated Dec. 27, 2011.

*Primary Examiner* — Briggitte R Hammond
(74) *Attorney, Agent, or Firm* — Eric D. Levinson

(57) ABSTRACT

A switch system having a user-activatable button and button travel limit feature is disclosed. The switch system includes a housing comprising an opening, a circuit board assembly positioned in the housing, and an electrical switch assembly connected to the circuit board. The button travel limit feature is adapted to inhibit motion of an activation surface of the user-activatable button towards the electrical switch assembly when the electrical switch assembly is activated.

13 Claims, 5 Drawing Sheets

U.S. PATENT DOCUMENTS

| | | | | |
|---|---|---|---|---|
| 5,929,407 | A | 7/1999 | Ziem | |
| 6,016,097 | A | 1/2000 | Gardner | |
| 6,260,936 | B1 | 7/2001 | Frank et al. | |
| 6,396,014 | B1 | 5/2002 | Minodier et al. | |
| 6,672,781 | B1 | 1/2004 | Takeda et al. | |
| 7,355,138 | B2 | 4/2008 | Chou | |
| 7,381,914 | B1 * | 6/2008 | Plesko et al. | 200/5 A |
| 2006/0231374 | A1 | 10/2006 | Braaten | |
| 2007/0137361 | A1 | 6/2007 | Fuji | |
| 2008/0170927 | A1 | 7/2008 | Boraas | |
| 2009/0057120 | A1 | 3/2009 | Kakuno et al. | |
| 2009/0107820 | A1 | 4/2009 | Michel et al. | |
| 2009/0173613 | A1 * | 7/2009 | Geldmacher | 200/5 A |
| 2009/0229961 | A1 | 9/2009 | Larsen et al. | |

FOREIGN PATENT DOCUMENTS

| | | | |
|---|---|---|---|
| EP | 1 288 984 | B1 | 12/2007 |
| GB | 604533 | | 7/1948 |
| GB | 885733 | | 12/1961 |
| GB | 932804 | | 7/1963 |
| GB | 2 087 154 | A | 5/1982 |
| GB | 2 264 393 | A | 8/1993 |
| JP | 8-007162 | | 1/1996 |
| JP | 2003-077359 | | 3/2003 |
| JP | 2003-109462 | | 4/2003 |
| JP | 2010-033713 | | 2/2010 |
| KR | 10-2006-0081785 | | 7/2006 |
| WO | WO 02/093599 | A1 | 11/2002 |

* cited by examiner

SWITCH SYSTEM HAVING A BUTTON TRAVEL LIMIT FEATURE

FIELD OF THE INVENTION

The invention relates to a switch system, and more particularly to a switch system having a button travel limit feature, which may be used to protect an electrical switch assembly.

BACKGROUND

Manually actuated switches have been used in a variety of applications ranging from automotive vehicles to computer keyboards. Because of the repetitious use of electrical switches, durability is an important characteristic of a well designed switch. A malfunctioning switch can prevent effective use of an entire device.

It is generally desirable for electrical switch assemblies to be capable of low cost of production as well as to be aesthetically and tactilely pleasing. Cost is often a function of the quantity of parts, quality of materials, and configuration of components. The goals of low cost and improved durability are often in tension.

Various switch system designs have been developed in an effort to improve durability and reliability of switch assemblies.

Some traditional switch assemblies use a plunger element to compress a conductive elastomeric dome which in turn completes an electrical circuit. The plunger may include a downwardly extending limiting mechanism to prevent overloading of the elastomeric domes or electrical circuit.

There remains a need for switch assemblies suitable for more applications that are more durable, more effective in sealing out moisture and debris, have a lower manufacturing cost, and have more desirable aesthetic and tactile characteristics.

SUMMARY

The present disclosure provides for a switch system that includes a housing having an opening, a circuit board assembly positioned in the housing, an electrical switch assembly connected to the circuit board, a user-activatable button positioned in the opening of the housing and a button travel limit feature. The user-activatable button is movable between an activating and non-activating position and includes an activation surface capable of contacting the electrical switch assembly. The button travel limit feature is positioned to inhibit motion of the activation surface of the user-activatable button towards the electrical switch assembly when the electrical switch assembly is activated.

In another embodiment, the switch system may include a housing having an opening, a circuit board assembly positioned in the housing, an electrical switch assembly connected to the circuit board, a user-activatable button positioned in the opening of the housing and a button travel limit feature. The user-activatable button is movable between an activating and non-activating position and includes an activation surface capable of contacting the electrical switch assembly. The button travel limit feature does not completely surround either a portion of the electrical switch assembly or a portion of the user-activatable button.

In yet another embodiment, the switch system may include a housing having an opening, a circuit board assembly positioned in the housing, an electrical switch assembly connected to the circuit board, a user-activatable button positioned in the opening of the housing and a button travel limit feature. The user-activatable button includes an activation member and a flexible membrane connecting the activation member to the housing such that the user-activatable button is movable between an activating and non-activating position.

BRIEF DESCRIPTION OF THE DRAWINGS

The disclosure may be more completely understood in consideration of the following detailed description of various embodiments of the disclosure in connection with the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

In the following description, reference is made to the accompanying drawings that form a part hereof, and in which are shown by way of illustrating several specific embodiments. It is to be understood that other embodiments are contemplated and may be made without departing from the scope or spirit of the present disclosure. The following detailed description, therefore, is not to be taken in a limiting sense.

All scientific and technical terms used herein have meanings commonly used in the art unless otherwise specified. The definitions provided herein are to facilitate understanding of certain terms used frequently herein and are not meant to limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

The present disclosure provides for a switch system that may be used to limit force transferred to a circuit board mounted switch. The switch system, in accordance with one embodiment, includes a housing, a circuit board assembly positioned in the housing, an electrical switch assembly connected to the circuit board, and a user-activatable button positioned in an opening of the housing. The user-activatable button is movable between an activating and non-activating position and includes an activation surface capable of contacting the electrical switch assembly. The switch system further includes a button travel limit feature positioned to inhibit motion of the activation surface of the user-activatable button towards the electrical switch assembly when the electrical switch assembly is activated.

Figure 1:
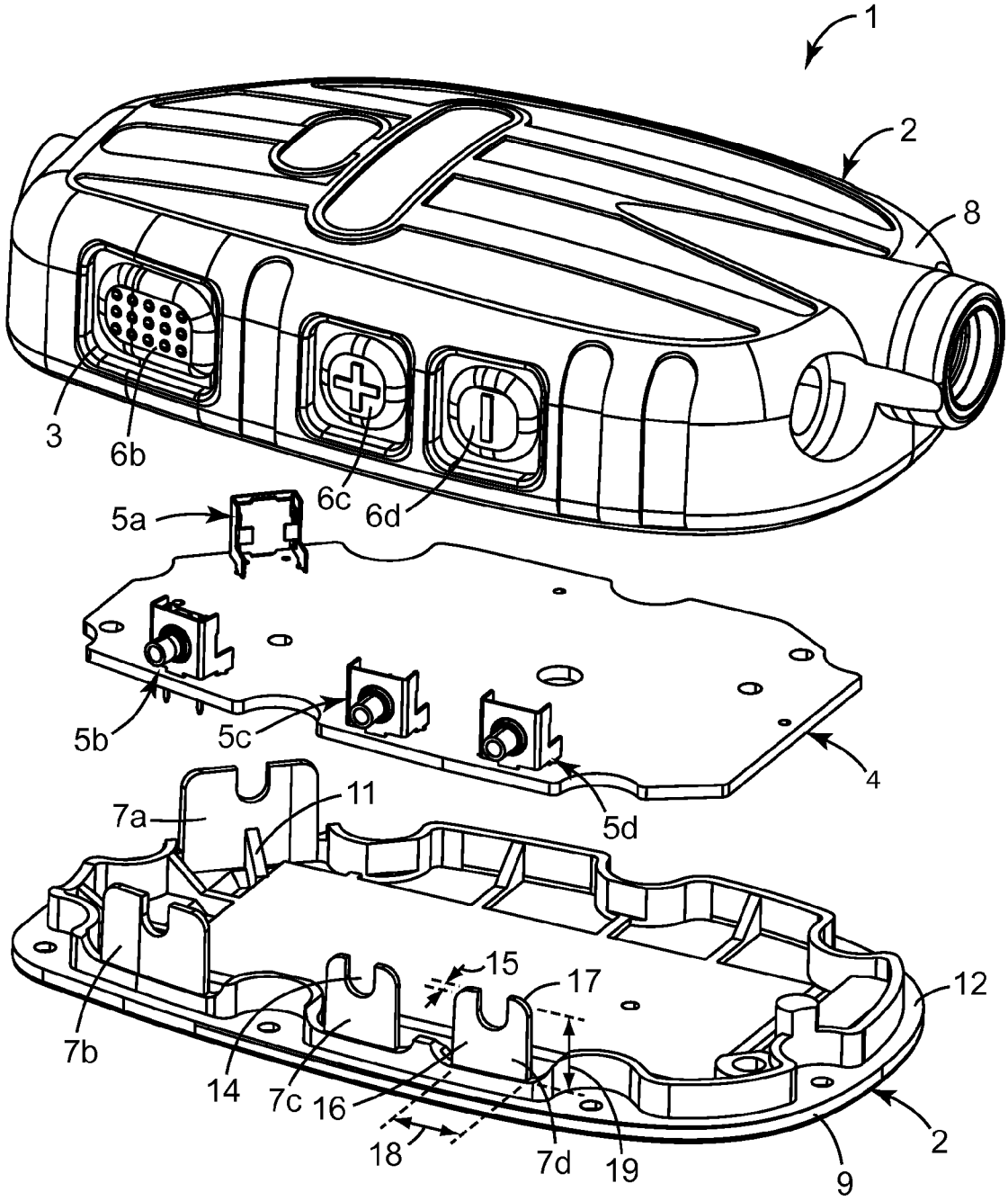
FIG. 1 is an exploded perspective view of a switch system having a button travel limit feature.

FIG. 1 illustrates a switch system 1 including a housing 2 having an opening 3, a circuit board assembly 4, electrical switch assemblies 5*a*, 5*b*, 5*c*, and 5*d*, user-activatable buttons 6*a* (not shown), 6*b*, 6*c*, and 6*d*, and button travel limit features 7*a*, 7*b*, 7*c*, and 7*d*. In this particular example, the switch system is implemented in a Push-to-Talk (PTT) control box.

The housing functions to enclose the switch assembly and any other elements associated with a device the switch assembly is used with, such as a PTT control box shown as an example in FIG. 1. The housing is intended to house the switch assembly, circuit board, and, in some embodiments, other suitable contents. Preferably, the housing is also intended to protect the switch assembly, circuit board, and, in some embodiments, other suitable contents, from damage associated with moisture, debris, shock, or other cause.

Figure 2:
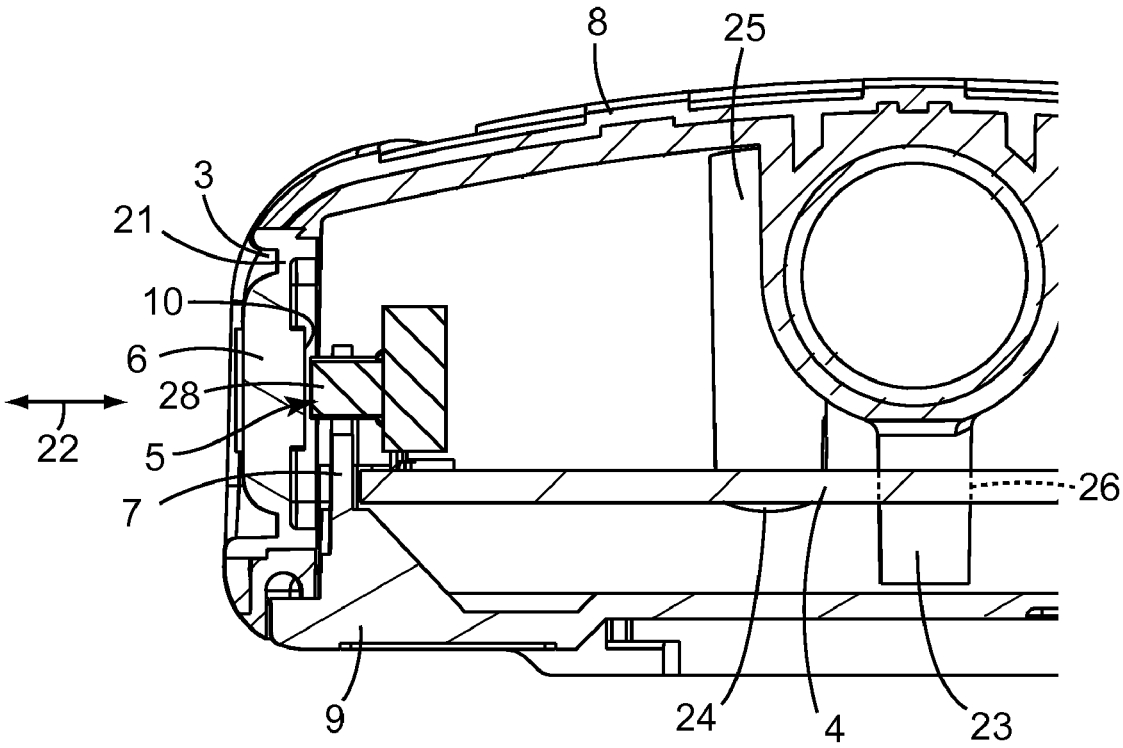
FIGS. 2 and 3 are sectional views of a switch system in a non-activating and activating position, respectively, having a button travel limit feature and a flexible membrane connecting a user-activatable button to the housing.

The housing may be made of any suitable number of portions or parts. In the embodiment illustrated in FIG. 1, the housing includes a first portion 8 and second portion 9. The second portion 9, configured as a cover, is adapted for fastening to the first portion 8, configured as an enclosure for receiving the circuit board assembly 4 and other components included in a PTT control box, for example. Referring to FIG. 2, the first portion 8 of the housing, configured as an enclosure, may contain one or more registration features 23, such as plastic posts, or other features to facilitate positioning of the circuit board assembly 4 inside the housing 2. The circuit board assembly 4 may be fastened into the first portion 8 of the housing using one or more mechanical fasteners, such as a screw 24, for example, cooperating with a corresponding feature 25 of the housing, one or more plastic snap-fits integrated into the first portion 8 of the housing, or other means. Similarly, the first portion 8 may be fastened to the second portion 9 by means of one or more mechanical fasteners, such as screws cooperating with features of the housing, plastic snap-fits integrated into the first and second portions of the housing, or other means. Alternatively, the first portion 8 and second portion 9 may be fastened with adhesive suitable for use with the materials of the housing.

Preferably, the first portion 8 and second portion 9 are adapted to form a seal to prevent substantial moisture and debris from entering the housing 2. A seal can be achieved by the cooperation of features of the first portion 8 with features of the second portion 9. For example, the seal may be formed by contact between a flange 12 on the second portion 9 of the housing and a corresponding surface on the first portion 8 of the housing such that moisture and debris are substantially prevented from entering the housing. In an alternative exemplary embodiment, a gasket may be positioned between the flange 12 and a corresponding surface on the first portion 8 of the housing. In another alternative exemplary embodiment, adhesive may be deposited between corresponding surfaces on the first portion 8 of the housing and second portion 9 of the housing to form a seal. Alternatively, a seal may be provided by other suitable means.

The housing 2 can be made from a variety of suitable materials. In an exemplary embodiment, the housing 2 is made of polycarbonate. Other exemplary materials include plastics and metals having sufficient rigidity and durability to house the contents of the device. The housing can be manufactured using a variety of suitable methods for the selected material. For example, injection molding techniques can be used to manufacture some embodiments. In some exemplary embodiments, one or more button travel limit features may be formed integrally with at least a portion of the housing, e.g., the second housing portion 9. Other techniques, such as casting, machining or forging may also be used.

Figure 3:
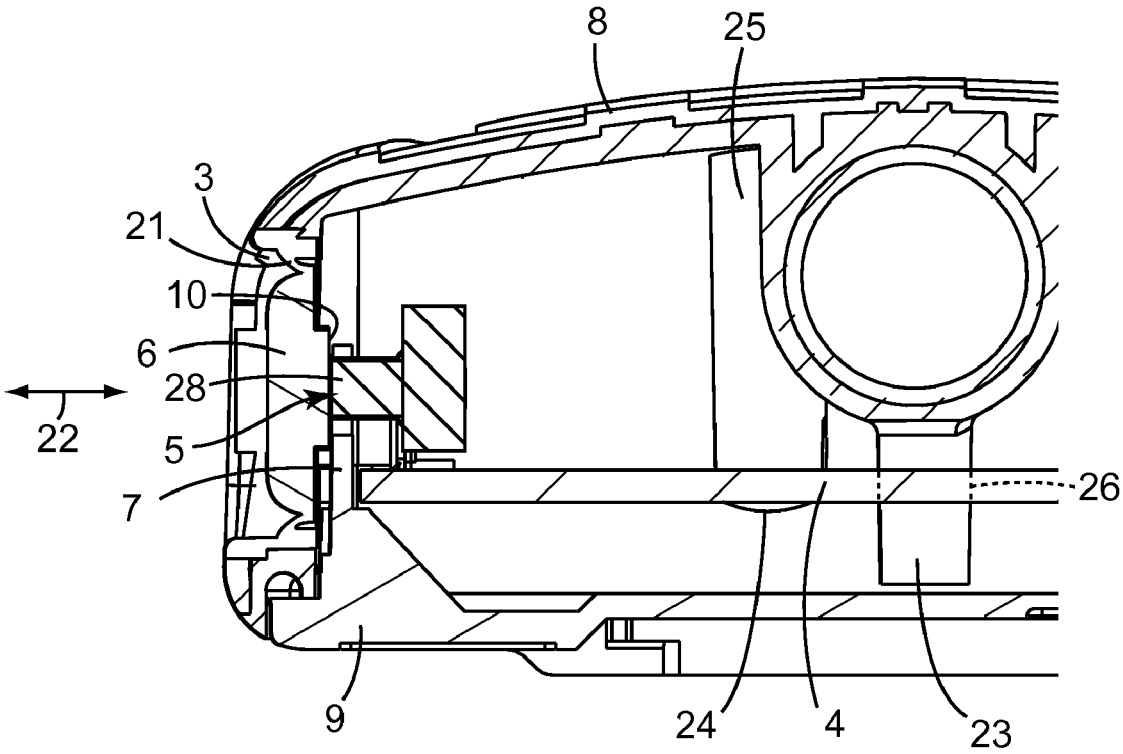

The user-activatable buttons 6*a* through 6*d* and button travel limit features 7*a* through 7*d* may be positioned on the housing 3, and electrical switch assemblies 5*a* through 5*d* may be positioned on circuit board assembly 4, such that they are substantially aligned when the switch system 1 is assembled, as illustrated in FIGS. 1 through 3. The first portion 8 of the housing may include one or more registration features 23 such as plastic posts and/or other features associated with corresponding features on the circuit board such as openings 26, depressions, tabs, or the like, for properly positioning and securing the circuit board assembly in the housing. One or more electrical switch assemblies 5*a*, 5*b*, 5*c*, or 5*d* may be activated when sufficient force is applied to one or more respective user-activatable buttons 6*a*, 6*b*, 6*c*, or 6*d* in the direction of activation 22.

FIG. 2 provides a perspective sectional view of one embodiment of a switch system in the non-activating position wherein the user-activatable button 6 is suspended in the opening 3 by a flexible membrane 21. The flexible membrane 21 exhibits sufficient elasticity such that the user-activatable button 6 can travel relative to the housing in order to activate the electrical switch assembly 5, as illustrated in FIG. 3. In an exemplary embodiment, the flexible membrane 21 has a thickness less than that of the user-activatable button 6 and thus exhibits flexibility greater than the user-activatable button 6 even if the flexible membrane 21 and user-activatable button 6 are made of identical materials.

When force is applied to the user-activatable button 6 in the direction of activation 22, for example, by a user's finger, the flexible membrane 21 elastically deforms allowing the activation surface 10 to come in contact with a plunger 28 or other activation means of the electrical switch assembly 5, as illustrated in FIG. 3. When the plunger 28, for example, of the electrical switch assembly 5 is displaced beyond a specified point, the electrical switch assembly 5 is activated and the function associated with the button is initiated. When the force is removed, the flexible membrane 21, user-activatable button 6, and plunger 28 or other activation means of the electrical switch assembly 5 return to the non-activating position.

In some exemplary embodiments, the flexible membrane 21 includes or is made of silicone rubber, while the user-activatable button 6 is made of a different material. In other exemplary embodiments, both the flexible membrane 21 and user-activatable button 6 are made of or include silicone rubber. Alternatively, the flexible membrane 21 and user-activatable button 6 can be made of any durable and flexible material including but not limited to thermoplastic rubbers or thermoplastic polyurethanes or a combination thereof.

In one embodiment, the flexible membrane 21 and user-activatable button 6 completely cover the opening 3 of the housing 2. In another embodiment, the flexible membrane 21 and user-activatable button 6 may cover only a portion of the opening 3 of the housing 2. The flexible membrane 21 and user-activatable button 6 may be substantially air and fluid impermeable so as to at least partially, or, preferably, completely, seal the opening 3 and prevent moisture and debris from entering the housing 2.

The flexible membrane 21 can be joined to the housing 2 in several suitable ways such as by using adhesive deposited between the periphery of the flexible membrane 21 and the corresponding surface of the housing 2. In alternative exemplary embodiments, the flexible membrane 21 can be joined to the housing 2 by overmolding, solvent welding, or other suitable methods. Alternatively, the flexible membrane 21 and user-activatable button 6 positioned in the opening 3 can be manufactured as features of the housing 2 during the injection molding process, for example. This could be achieved by varying the thickness of the housing such that a flexible membrane 21 and user-activatable button 6 result in the housing 2. In such exemplary embodiments, the term "opening" refers to the area of the housing 2 that is occupied by the flexible membrane 21 and the user-activatable button 6.

With further reference to FIGS. 2 and 3, a button travel limit feature 7 is positioned to inhibit motion of an activation surface 10 of the user-activatable button 6 towards the electrical switch assembly 5 when the electrical switch assembly 5 is activated. By doing so, the electrical switch assembly 5 is protected from force in excess of a predetermined value the electrical switch is designed to tolerate. In addition to protecting the electrical switch assembly 5 and the electrical connections between the electrical switch assembly 5 and the circuit board assembly 4, the button travel limit feature 7 of the present disclosure protects the integrity of the mechanical connections joining the electrical switch assembly 5 to the circuit board assembly 4.

Figure 6A:
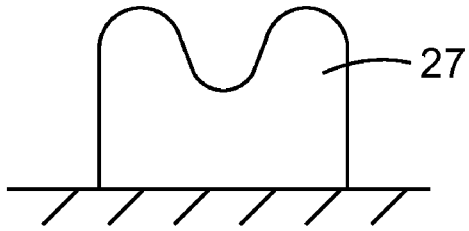
FIGS. 6A through 6D provide schematic front views of a various embodiments of the button travel limit feature.

In an exemplary embodiment illustrated in FIG. 1, and shown in isolation in FIG. 6A, one or more of button travel limit features 7*a*, 7*b*, 7*c*, or 7*d*, or 27 have at least a portion that protrudes from a portion of the housing in a direction generally orthogonal to a plane created by the circuit board assembly. However, in other exemplary embodiments, the button travel limit feature 7 may have portions that protrude from a portion of the housing in a direction that is parallel to a plane created by the circuit board assembly, a direction that crosses a plane created by the circuit board assembly, or a combination thereof.

FIG. 1 illustrates button travel limit features 7*a*, 7*b*, 7*c*, and 7*d* associated with electrical switch assemblies 5*a*, 5*b*, 5*c*, and 5*d*, respectively. One or more of the button travel limit features 7*a*, 7*b*, 7*c*, or 7*d* may have a generally planar shape, for example, including a first major surface 16 and a second major surface 17, separated by a thickness 15 and having a width 18 and a height 19. In some exemplary embodiments, the first major surface 16 and second major surface 17 may be planar surfaces, which, in some exemplary embodiments are generally parallel to each other. One or more of the button travel limit features 7*a*, 7*b*, 7*c*, or 7*d* may have a depression 14 or other recess that a portion of electrical switch assembly 5*a*, 5*b*, 5*c*, or 5*d* or user-activatable button 6*a*, 6*b*, 6*c*, or 6*d* may travel between, through, over, or under. The depression or recess may have or include any suitable shape, such as the shape of a U, a section of a circle, a rectangle, any other suitable shape or a combination thereof.

In one embodiment, the button travel limit feature 7 has a shape such that the button travel limit feature does not completely surround either a portion of the electrical switch assembly 5 or the user-activatable button 6. That is, the button travel feature does not completely encircle, for example, a plunger 28 of an electrical switch assembly 5 as shown in FIG. 2. In this exemplary embodiment, the button travel limit feature 7 exhibits a generally rectangular outline (optionally, with one or more rounded corners) and a generally u-shaped depression or recess to accommodate a plunger 28 of the electrical switch assembly, for example, or a portion of the user-activatable button. Such a shape facilitates quick and easy assembly.

The dimensions of the button travel limit feature 7 can be varied to meet the specifications of a particular application. In an exemplary embodiment, the width and height of the button travel limit feature 7 is of the same order of magnitude as the dimensions of the user-activatable button 6 such that motion of an activation surface 10 of the user-activatable button 6 towards the electrical switch assembly 5 is inhibited when the electrical switch assembly 5 is activated. The ratio of the thickness of the button travel limit feature 7 to the width of the button travel limit feature 7 may be less than 1:1, is preferably less than 1:2, and is more preferably less than 1:4. In an exemplary embodiment, the button travel limit feature has a width between approximately 6 and 25 mm, a height between approximately 6 and 25 mm and a thickness between approximately 1 and 6 mm.

During assembly, as illustrated in FIG. 1, the circuit board assembly 4 is first positioned and fastened in the first portion 8 of the housing configured as an enclosure. The shape of the one or more button travel limit features according to the present disclosure allows the second portion 9 of the housing, configured as a cover, to simply be positioned and fastened to the first portion 8 of the housing. In this exemplary embodiment, one or more button travel limit features 7*a*, 7*b*, 7*c* or 7*d* are disposed on the second portion 9 of the housing 2. Thus, when the first and second housing portions 8 and 9 are assembled, the button travel limit feature(s) will be properly interposed between the user-activatable button(s) and the electrical switch assembly(ies) without additional and difficult assembly steps associated with, for example, placing a portion of the electrical switch assembly or the user-activatable button through a completely encircled opening in the button travel limit feature. In particular, the plungers 28 of the switch assembly(ies) 5*a* through 5*d*, for example, may be accommodated in the recess(es) 14 of the button travel limit features 7*a* through 7*d*.

Figure 6B:
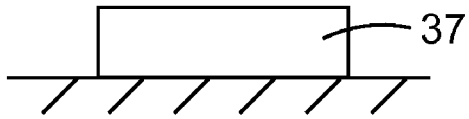
Figure 6C:
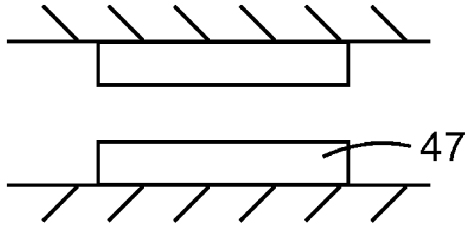
Figure 6D:
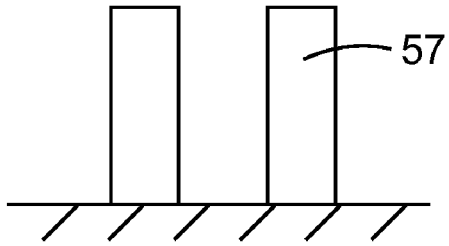

FIGS. 6B through 6D provide additional embodiments of a button travel limit feature that does not completely surround either a portion of the electrical switch assembly 5 or a portion of the user-activatable button 6. The button travel limit feature may be of any shape having one or more curved edges, straight edges or a combination thereof that inhibit motion of an activation surface 10 of the user-activatable button 6 towards the electrical switch assembly 5 when the electrical switch assembly 5 is activated. For example, the button travel limit feature may be shaped as a rectangle or multiple rectangles protruding from a portion or portions of the housing as illustrated in FIGS. 6B, and 6C. The presence of a depression or other recess as described above may be unnecessary for the button travel limit feature to function as desired in some embodiments. Alternatively, the button travel limit feature may be of a curved shape or any combination of shapes having curved or straight edges, one exemplary shape of which is provided in FIG. 6A. In another embodiment, the button travel limit feature may consist of one or more posts extending from a portion of the housing, as illustrated by FIG. 6D, exhibiting a rectangular or cylindrical shape or any combination of straight or curved edges.

Figure 4:
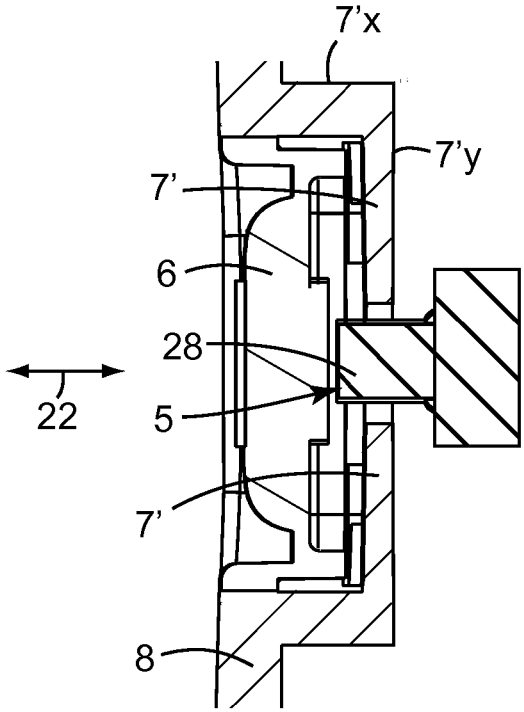
FIG. 4 is a top sectional view of a switch system having a button travel limit feature projecting outwardly from the housing in the direction of activation.
Figure 5:
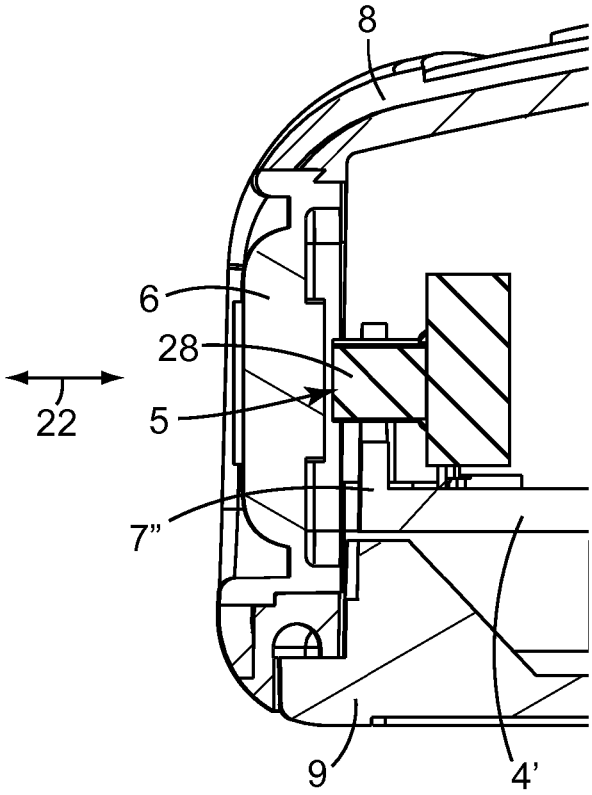
FIG. 5 is a sectional view of a switch system having a button travel limit feature fixed to the circuit board assembly.

In another embodiment, the button travel limit feature 7' can include a portion 7'*x* that projects outward from a portion of the housing 2 in the direction of activation 22 of the electrical switch assembly 5, as illustrated in FIG. 4, in addition to a portion 7'*y* that projects across the direction of activation 22 of the electrical switch assembly 5. Alternatively, the button travel limit feature 7" may be fixed to the circuit board assembly 4 as illustrated in FIG. 5. In these embodiments, the button travel limit features 7' and 7" function in a manner as described above but may be preferred for manufacturing considerations, to facilitate the arrangement of various components of a PTT control box, for example, in the housing 2, or for other considerations.

In the embodiment shown in FIGS. 2 and 3, the button travel limit feature 7 serves multiple purposes. In addition to protecting the electrical switch assembly 5 from excessive force, the button travel limit feature 7 protects the flexible membrane 21 of the user-activatable button from excessive deformation. Plastic deformation of the flexible membrane 21 can result in the inability to return the button to the non-activating position. Further, to the extent that the flexible membrane 21 tears or otherwise breaks, the flexible membrane 21 may no longer seal the housing from moisture and debris and may have diminished aesthetic qualities.

The button travel limit feature 7 can be manufactured with a portion of the housing 2 as a single part. Alternatively, the button travel limit feature 7 can be manufactured separately and fastened to a portion of the housing 2 using suitable adhesive or mechanical fasteners such as screws or plastic snap-fit fasteners.

The button travel limit feature 7 can be made from a variety of suitable materials. In an exemplary embodiment, the button-travel limit feature 7 is made of the same or different material as the housing 2 and may be made of polycarbonate, for example. Alternatively, other materials may be used. In other exemplary embodiments, the button travel limit feature 7 and the housing 2 may be made of or include different materials. Suitable materials preferably provide sufficient rigidity to limit excessive force otherwise transferred to the electrical switch assembly 5 when the user-activatable button 6 is intentionally or accidentally pressed.

To provide extra support and protection from excessive force, a support feature 11 may optionally be provided (shown in FIG. 1). The exemplary support feature 11 protrudes from the button travel limit feature 7 and is fixed to the housing 2, providing additional stability to the button travel limit feature 7. In an exemplary embodiment, the support feature may be shaped as a truss or triangular protrusion extending between a portion of one or more of button travel limit features 7*a*, 7*b*, 7*c*, or 7*d* and a portion of the housing 2, as illustrated in FIG. 1.

Figure 7:
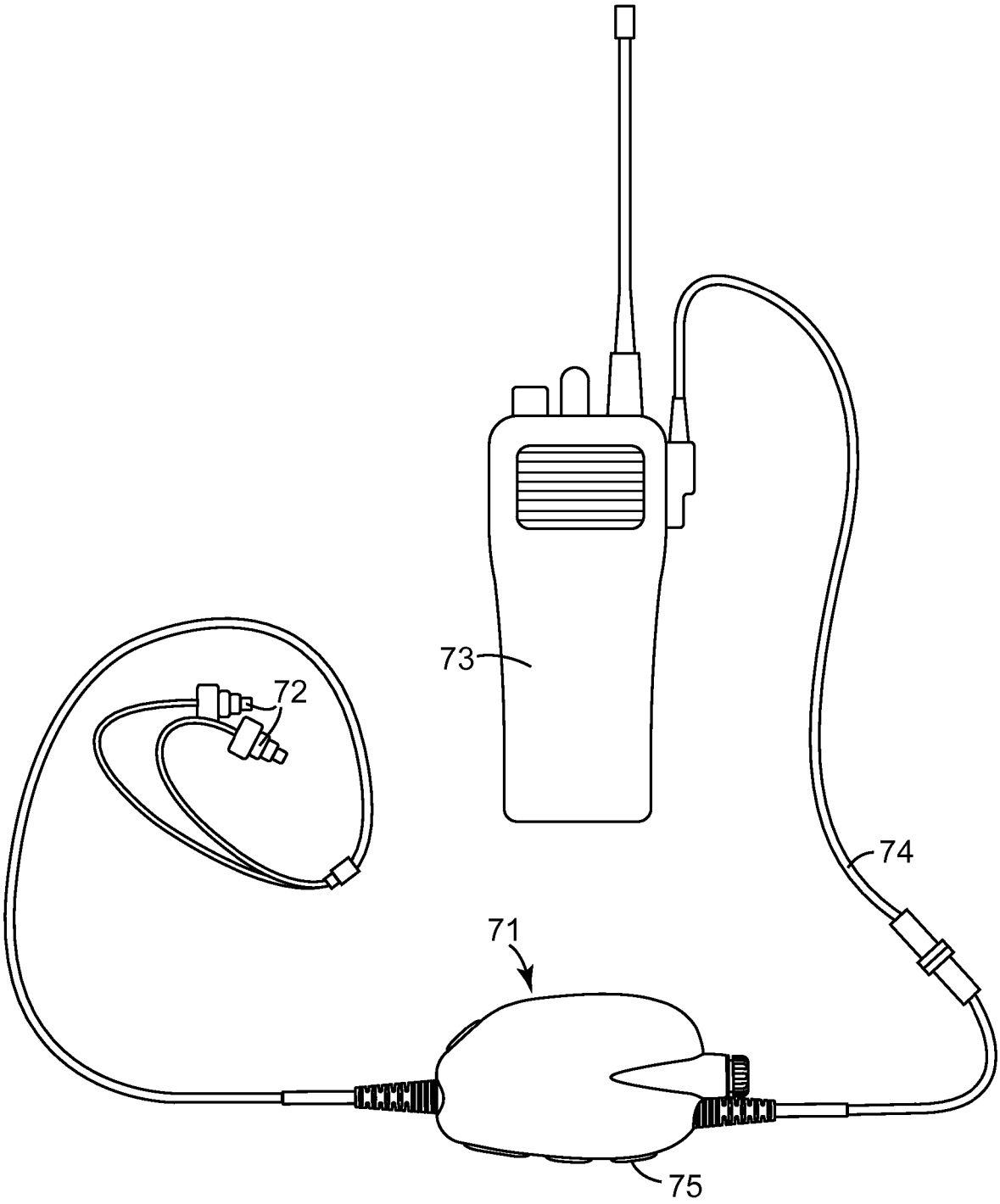
FIG. 7 provides a perspective view of an assembled PTT control box, in which exemplary embodiments of the present disclosure can be implemented, with cables and hearing protection.

FIG. 7 illustrates an exemplary implementation of the switch system of the present disclosure. A switch system as shown and described in connection with FIGS. 1 through 5, may be implemented in a PTT control box 71 connected to hearing protection 72, such as a pair of ear plugs, and a radio 73 by a cable 74, for example. In particular, an exemplary switch system (not shown) may be disposed in the housing of the PTT control box 71. The durability of the switch system (s) according to the present disclosure allows a user to reliably activate various functions of the PTT control box by pressing the user-activatable buttons 75.

In addition to the aforementioned benefits of individual features of the switch system, the switch system of the present disclosure includes several benefits unaddressed by traditional switch assemblies. The switch system of the present disclosure is comprised of relatively few parts, limiting the cost of production. Further, the switch system of the present disclosure protects not only components of the electrical switch, but also the mechanical and electrical connections between the electrical switch assembly and the circuit board assembly. The user-activatable button preferably suspended by a flexible membrane is adapted for desirable aesthetic and tactile characteristics and is preferably manufactured and assembled to provide a seal against moisture and debris. The button travel limit feature of the present disclosure serves also to protect the functionality of the user-activatable button both in activating the electrical switch assembly and in sealing the housing from moisture and debris.

The switch system has now been described with reference to several embodiments thereof. It will be apparent to those skilled in the art that many changes can be made without departing from the scope of the invention. Thus, it should be understood that this disclosure presents the invention by way of representation and not limitation. It should further be understood that the individual features described above are contemplated to function in any combination and with many types of devices. The different features have merely been grouped together to provide clarity.

What is claimed is:

1. A switch system comprising:

a) a housing comprising an opening, b) a circuit board assembly positioned in the housing, c) an electrical switch assembly connected to the circuit board, d) a user-activatable button positioned in the opening of the housing and movable between an activating and non-activating position wherein the button comprises an activation surface capable of contacting the electrical switch assembly, and e) a button travel limit feature, wherein the button travel limit feature is positioned to inhibit motion of the activation surface of the user-activatable button towards the electrical switch assembly after the activation surface contacts the electrical switch assembly, wherein the button travel limit feature by itself provides sufficient rigidity to limit excessive force from being transferred to the electrical switch assembly.

2. The switch system of claim 1, wherein the button travel limit feature projects from a portion of the housing in a direction generally orthogonal to a plane created by the circuit board assembly.

3. The switch system of claim 1, wherein the button travel limit feature is interposed between the user-activatable button and the electrical switch assembly.

4. The switch system of claim 1, wherein a portion of the button travel limit feature projects from a portion of the housing in a direction of activation of the electrical switch assembly.

5. The switch system of claim 1, wherein the button overtravel limit feature is fixed to the circuit board assembly.

6. The switch system of claim 1, wherein the housing comprises at least first and second portions, wherein the first portion comprises an enclosure and the second portion is adapted to be fastened to the first portion.

7. The switch system of claim 6, wherein the button travel limit feature is fixed to the second portion of the housing.

8. A switch system comprising:

a) a housing comprising an opening, b) a circuit board assembly positioned in the housing, c) an electrical switch assembly connected to the circuit board, d) a user-activatable button positioned in the opening of the housing and movable between an activating and non-activating position wherein the button comprises an activation surface capable of contacting the electrical switch assembly, and e) a button travel limit feature that partially, but not completely, surrounds either a portion of the electrical switch assembly or a portion of the user-activatable button.

9. The switch system of claim 8, wherein the button travel limit feature comprises one or more curved edges.

10. The switch system of claim 8, wherein the button travel limit feature comprises one or more straight edges.

11. A switch system, comprising:

a) a housing comprising an opening, b) a circuit board assembly positioned in the housing, c) an electrical switch assembly connected to the circuit board, d) a user-activatable button positioned in the opening of the housing and movable between an activating and non-activating position wherein the button comprises an activation surface capable of contacting the electrical switch assembly, and e) a button travel limit feature that does not completely surround either a portion of the electrical switch assembly or a portion of the user-activatable button, wherein the button travel limit feature comprises two substantially parallel protrusions extending from a portion of the housing.

12. The switch system of claim 8, wherein the button travel limit feature comprises a support feature fixed to the enclosure.

13. A push to talk (PTT) control system, comprising:

a push to talk (PTT) box, comprising:

a) a housing comprising an opening, b) a circuit board assembly positioned in the housing, c) an electrical switch assembly connected to the circuit board, d) a user-activatable button positioned in the opening of the housing and movable between an activating and non-activating position wherein the button comprises an activation surface capable of contacting the electrical switch assembly, and e) a button travel limit feature, wherein the button travel limit feature is positioned to inhibit motion of the activation surface of the user-activatable button towards the electrical switch assembly after the activation surface contacts the electrical switch assembly, wherein the button travel limit feature by itself provides sufficient rigidity to limit excessive force from being transferred to the electrical switch assembly;

hearing protection connected to the PTT box; and a radio connected to the PTT box via a cable.

* * * * *